US010626707B2

(12) United States Patent
Gao et al.

(10) Patent No.: US 10,626,707 B2
(45) Date of Patent: Apr. 21, 2020

(54) FLUSHING FILTER

(71) Applicant: Halliburton Energy Services, Inc., Houston, TX (US)

(72) Inventors: Bo Gao, Spring, TX (US); Nicholas Budler, Claremore, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 287 days.

(21) Appl. No.: 15/568,043

(22) PCT Filed: Jun. 30, 2015

(86) PCT No.: PCT/US2015/038490
§ 371 (c)(1),
(2) Date: Oct. 20, 2017

(87) PCT Pub. No.: WO2017/003445
PCT Pub. Date: Jan. 5, 2017

(65) Prior Publication Data

US 2018/0112499 A1 Apr. 26, 2018

(51) Int. Cl.

| | |
|---|---|
| ***E21B 33/14*** | (2006.01) |
| ***E21B 43/08*** | (2006.01) |
| ***E21B 27/00*** | (2006.01) |
| *E21B 17/042* | (2006.01) |

(52) U.S. Cl.
CPC ..... *E21B 43/086* (2013.01); *E21B 27/005* (2013.01); *E21B 33/14* (2013.01); *E21B 17/042* (2013.01)

(58) Field of Classification Search
CPC ..... E21B 17/042; E21B 27/005; E21B 33/14; E21B 43/086
See application file for complete search history.

(56) References Cited

U.S. PATENT DOCUMENTS 834,431 A * 10/1906 Williams ..... B01D 35/02 210/448
1,135,809 A * 4/1915 Jones ..... E21B 43/103 166/195
3,245,540 A * 4/1966 Johnson ..... B01D 24/12 210/291
3,450,207 A * 6/1969 Hirsch ..... E21B 43/086 166/233

(Continued)

FOREIGN PATENT DOCUMENTS

CN 2687330 3/2005
CN 201228528 4/2009

(Continued)

OTHER PUBLICATIONS

Canadian Application No. 2,984,946 , Office Action, dated Oct. 11, 2018, 5 pages.

(Continued)

*Primary Examiner* — Daniel P Stephenson
(74) *Attorney, Agent, or Firm* — Kilpatrick Townsend & Stockton LLP

(57) ABSTRACT

An apparatus can include a filter element that is positionable in a tubing string. The filter element can have a closed end and an open end. A plurality of slots can extend generally radially from the closed end to the open end of the filter element along a length of the filter element.

19 Claims, 6 Drawing Sheets

(56) References Cited

U.S. PATENT DOCUMENTS

| | | | | |
|---|---|---|---|---|
| 3,458,050 | A * | 7/1969 | Cooper | B01D 35/02 210/448 |
| 4,495,073 | A | 1/1985 | Beimgraben | |
| 5,901,789 | A * | 5/1999 | Donnelly | E21B 43/04 166/381 |
| 5,916,435 | A * | 6/1999 | Spearman | B01D 29/23 210/132 |
| 6,468,427 | B1 * | 10/2002 | Frey | A61M 1/3627 210/497.01 |
| 6,598,685 | B1 * | 7/2003 | Mashburn | E21B 21/002 166/227 |
| 6,976,546 | B2 * | 12/2005 | Herst | E21B 21/065 175/57 |
| 7,243,742 | B2 * | 7/2007 | Kutryk | B01D 35/02 166/158 |
| 7,487,831 | B2 | 2/2009 | Pluchek et al. | |
| 8,028,768 | B2 * | 10/2011 | Hall | E21B 27/005 166/205 |
| 8,182,702 | B2 * | 5/2012 | Al-Sannaa | B01D 35/02 210/448 |
| 8,230,913 | B2 * | 7/2012 | Hart | E21B 43/106 166/207 |
| 8,454,829 | B2 | 6/2013 | Yaeger et al. | |
| 8,651,181 | B2 | 2/2014 | Knobloch et al. | |
| 9,598,919 | B1 * | 3/2017 | Cantrell | E21B 23/006 |
| 10,053,960 | B2 * | 8/2018 | Romero | E21B 21/003 |
| 10,125,579 | B2 * | 11/2018 | Gao | E21B 27/005 |
| 10,233,730 | B2 * | 3/2019 | Gao | E21B 27/005 |
| 10,233,731 | B2 * | 3/2019 | Gao | E21B 27/005 |
| 10,415,352 | B2 * | 9/2019 | Thomas | E21B 43/086 |
| 2005/0109503 | A1 * | 5/2005 | Kutryk | B01D 35/02 166/227 |
| 2006/0065443 | A1 | 3/2006 | Hall et al. | |
| 2006/0065444 | A1 * | 3/2006 | Hall | E21B 17/003 175/314 |
| 2006/0213667 | A1 | 9/2006 | Mashburn et al. | |
| 2010/0236833 | A1 | 9/2010 | Hall et al. | |
| 2018/0112499 | A1 * | 4/2018 | Gao | E21B 27/005 |
| 2018/0135371 | A1 * | 5/2018 | Cherewyk | E21B 21/002 |

FOREIGN PATENT DOCUMENTS

| | | |
|---|---|---|
| CN | 104514503 | 4/2015 |
| EP | 1413709 | 7/2010 |

OTHER PUBLICATIONS

International Patent Application No. PCT/US2015/038490 , "International Search Report and Written Opinion", dated Mar. 11, 2016, 13 pages.

Weatherford , "MudMaster II Filter Shoe and Auto-Fill Float Equipment", retrieved from the internet at http://www.weatherford.com/doc/wft022658, at least as early as May 5, 2015, 4 pages.

* cited by examiner

FLUSHING FILTER

TECHNICAL FIELD

The present disclosure relates generally to wellbore completion. More specifically, but not by way of limitation, this disclosure relates to filter assemblies for use in controlling the entry of debris and particulate materials into a casing string.

BACKGROUND

During completion of the wellbore the annular space between the wellbore wall and a casing string (or casing) can be filled with cement. This process can be referred to as "cementing" the wellbore. The casing string can include floating equipment, for example a float collar and a guide shoe. Fluid, such as drilling fluid or mud, can be present within the wellbore. The fluid can include debris such as particulate materials. The fluid, including the debris, can enter the casing string and can contact the floating equipment. The debris can partially or fully clog the valves of the floating equipment. The floating equipment can fail to function properly during the cementing of the wellbore when the valves are partially or fully clogged. The cement job can be weak or otherwise fail to properly function when the floating equipment fails to properly function, for example due to clogged valves or the resulting contaminated cement.

DETAILED DESCRIPTION

Figure 1:
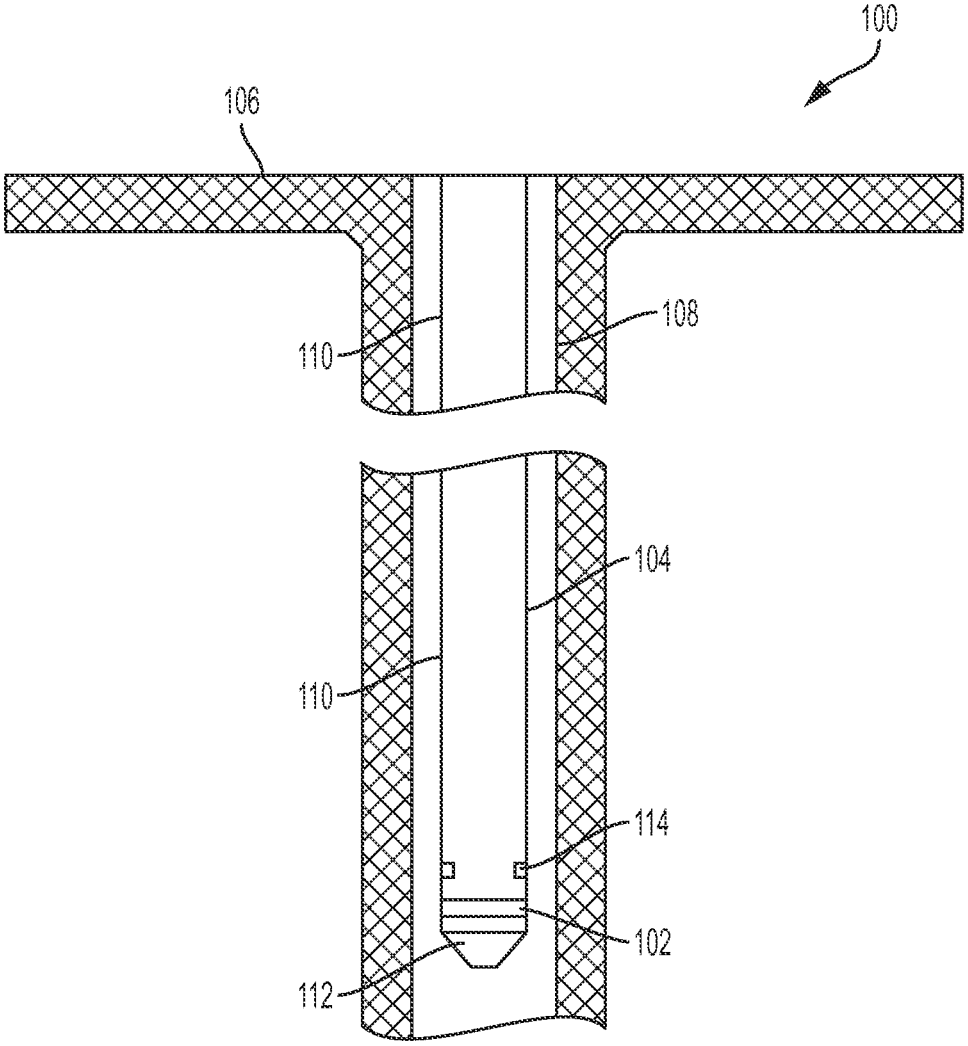
FIG. 1 is a schematic of a well system including a filter assembly positioned within a casing string, according to an aspect of the present disclosure.

Certain aspects and features of the present disclosure are directed to a filter assembly for preventing debris particles (or particles) from entering floating equipment within a casing string. The filter assembly can be positioned within the casing string. In some aspects, the filter assembly can be positioned within a casing shoe of the casing string. The filter assembly can be coupled to the casing string at the well site, or in some aspects, the filter assembly can be coupled to a substitute piece of threaded pipe ("sub"). The sub that includes the filter assembly can be coupled to a casing tube of the casing string at the well site. The casing string can also include floating equipment, for example but not limited to a float collar or a guide shoe.

The filter assembly can include a closed end (an apex) and an open end (a base). The filter assembly may be generally conical in shape or cylindrical in shape, which may include a parabolic shape, though other suitable shapes could be used. The filter assembly can include multiple slots that can extend from the apex longitudinally to the base of the filter assembly. In some aspects, the slots may be described as longitudinal slots. The slots can extend radially from the apex. Additional perforations may be located at the apex. The perforations may be randomly distributed or may be positioned to form a geometrical shape, for example a circle or a polygon. The filter assembly can be coupled to a casing string such that a maximum inner diameter of the filter assembly at the base can be approximately the same as the inner diameter of the casing string.

The filter assembly can be positioned within the casing string such that the base of the filter assembly is positioned downhole from the apex of the filter assembly. Fluid, such as mud and drilling fluid, can enter the casing string. The fluid can include debris particles that can clog the valves of floating equipment or contaminate the cement. The fluid can enter the open end of the filter assembly and can pass through the slots of the filter assembly. Debris particles in the fluid that are larger than the width of the slots of the filter assembly can be stopped by the slots. The particles stopped by the slots can be forced along the length of the slot towards the apex of the filter assembly. The particles can be forced along by the flow of the fluid through the filter along a path of least resistance towards the apex. The region of the slots proximate to the base of the filter assembly can remain free of particles and fluid can continue to flow through that region as the particles accumulate proximate to the apex of the filter assembly. By accumulating the particles proximate to the apex of the filter assembly and keeping the region of the slots proximate to the base of the filter unclogged, the filter can continue function even as debris particles collect at the apex.

In some aspects, the filter assembly can be positioned within the casing string such that the apex of the filter assembly is downhole from the base of the filter assembly. The particles can be stopped by the slots and can be forced along the slots towards the base of the filter assembly. The particles can accumulate in a region proximate to the base of the filter assembly between the filter assembly and the casing string. The fluid can continue to flow through the slots proximate to the apex of the filter assembly.

In some aspects, the filter assembly can include two or more filter elements. A first filter element can be positioned proximate to the downhole end of the casing string and can have slots that have a larger width than the slots of an additional filter element. The additional filter element can be positioned uphole relative to the first filter element. The use of multiple filter elements within the casing string, each having slots of progressively narrower width, can progressively filter the fluid entering the casing string.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative examples but, like the illustrative examples, should not be used to limit the present disclosure.

FIG. 1 is a schematic diagram of a well system 100 that includes a filter assembly 102 positioned within a tubing string, for example casing string 104. The casing string 104 can extend from a surface 106 of a wellbore 108 into a subterranean formation. The casing string 104 can be run into the wellbore 108 to protect or isolate formations adjacent to the wellbore 108. The casing string 104 can be comprised of multiple casing tubes 110 that can be coupled together at the surface 106 and positioned within the wellbore 108.

The casing string 104 can include a casing shoe 112. In some aspects, the casing shoe 112 can be a guide shoe or a float shoe. The casing shoe 112 can help guide the casing string 104 as it is positioned within the wellbore 108. The filter assembly 102 can be positioned within the casing string 104, for example above the casing shoe 112. In some aspects, the filter assembly 102 can be positioned elsewhere in the casing string 104, for example but not limited to in the casing shoe 112.

The casing string 104 can include floating equipment 114, for example but not limited to a float collar or a guide shoe. The floating equipment 114 can be used during cementing of the wellbore 108. The floating equipment 114 can include valves that can become fully or partially clogged by debris particles that enters the casing string 104. The floating equipment 114 can fail to properly function when the valves are fully or partially clogged. The cementing of the wellbore 108 can be weak or otherwise fail to properly function when the floating equipment 114 fails to properly function or the cement is contaminated with debris.

The filter assembly 102 can filter debris particles from fluid that enters the casing string 104. The filter assembly 102 can prevent the particles from entering the casing string 104 and partially or fully clogging the valves of the floating equipment 114. In some aspects, the filter assembly 102 can also prevent the debris particles from passing through the casing shoe 112 and clogging a valve of the casing shoe 112.

Figure 2:
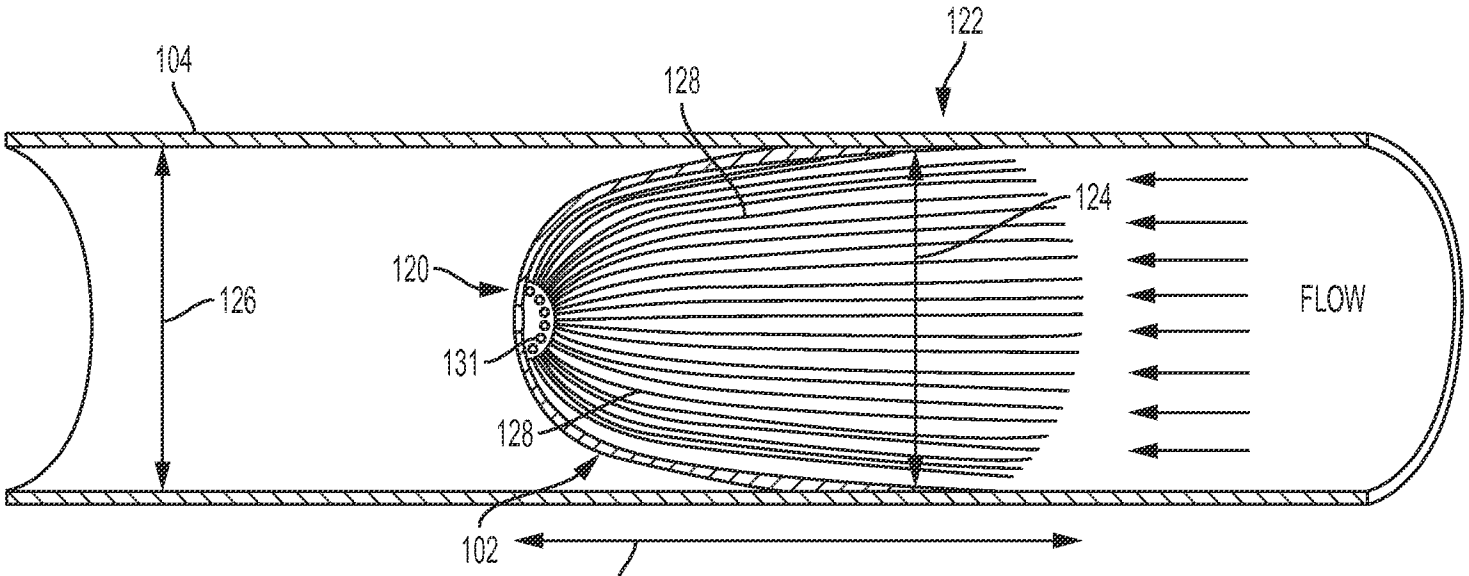
FIG. 2 is a cross-sectional view depicting an example of a filter assembly, according to an aspect of the present disclosure.

FIG. 2 is a cross-sectional depiction of the filter assembly 102 positioned within the casing string 104. The filter assembly 102 is generally conical in shape and may be described as parabolic in shape, though in some aspects other suitable shapes could be used. In some aspects, the filter assembly could be cylindrical in shape, semi-spherical in shape, or any other suitable shape. The filter assembly 102 can extend radially from an apex 120 to a base 122. The apex 120 may have a curved or rounded shape. The filter assembly 102 can be open at the base 122. The filter assembly 102 can have an inner diameter that is smaller at the apex 120 and larger at the base 122. The filter assembly 102 can have a maximum inner diameter 124 at the base 122. The filter assembly 102 can be coupled to the casing string 104 proximate to the base 122. The maximum inner diameter 124 of the filter assembly 102 can be approximately the same as an inner diameter 126 of the casing string 104. In some aspects, the casing string 104 can be a sub that can be in a range of approximately 2 feet to approximately 40 feet in length, though other suitable lengths may be used, and can be coupled to the casing tube of the casing string 104.

The filter assembly 102 can be in a range of approximately 1 foot to approximately 6 feet in length, though other suitable lengths may be used. The length of the filter assembly 102 can be selected based on the characteristics of the well the filter assembly 102 will be used in. For example, in a well having wellbore fluids containing a high concentration of debris particles the filter assembly 102 can be in a range of approximately 4 feet to approximately 6 feet in length. The filter assembly can comprise a drillable material, for example but not limited to, a composite, phenolic, aluminum or other suitable drillable material.

The filter assembly 102 can be positioned within the casing string 104 with the opening at the base 122 facing in a downhole direction. Fluid can enter the filter assembly 102 at the base 122 of the filter assembly 102 and flow towards the apex 120 as depicted by the arrows in FIG. 2. The filter assembly 102 can include longitudinal slots 128. The longitudinal slots 128 can extend radially from the apex 120 along a length 130 of the filter assembly 102 to the base 122. The longitudinal slots 128 may extend continuously along the length 130 of the filter assembly 102. The longitudinal slots 128 may intersect at the apex 120. In some aspects, multiple perforations 131 can be positioned at the apex 120. The perforations 131 can be randomly distributed, can be positioned to form a geometric shape, for example a circle or a polygon, or can be a combination of random distribution and geometric shapes. The perforations 131 can be circular, triangular, oval, or any other suitable shape. In some aspects, no perforations are included in the filter assembly 102. In some aspects, a geometrically shaped slot, for example a circular shaped slot, could be used in place of the perforations 131.

The longitudinal slots 128 can have a uniform width. The perforations 131 can have the same width as the longitudinal slots 128 or a different width. In some aspects, the width of the longitudinal slots 128 can be in the range of approximately 0.1 mm to approximately 0.5 mm, though in some aspects other suitable widths may be used. The width of the longitudinal slots 128 can be selected based on knowledge regarding characteristics of the well the filter assembly 102 will be used in. For example, in a well in which a high percentage of the debris particles in the fluid entering the casing string 104 have a width of 0.5 mm or larger, a filter assembly 102 with longitudinal slots 128 having a width of 0.4 mm can be used. In another aspect, in a well in which a high percentage of the debris particles in the fluid entering the casing string 104 a width of 0.2 mm or larger, a filter assembly 102 with longitudinal slots 128 having a width of 0.1 mm can be used.

In some aspects, the width of the longitudinal slots 128 can change between the apex 120 and the base 122. For example, a length of the longitudinal slots 128 proximate to the apex 120 can have a minimum width. The width of the longitudinal slots 128 can increase as the longitudinal slots 128 extend along the length 130 of the filter assembly 102 towards the base 122.

The fluid and debris particles can flow into the filter assembly 102. The fluid can follow the path of least resistance within the filter assembly 102. Some of the fluid can pass through the longitudinal slots 128 of filter assembly 102 proximate to the base 122 of the filter assembly 102. Some of the fluid can pass through the longitudinal slots 128 elsewhere along the length of the filter assembly 102. Some of the fluid can flow along a path of least resistance that extends along the length of the longitudinal slots 128 from the base 122 towards the apex 120 of the filter assembly 102. The fluid can pass through the longitudinal slots 128 proximate to the apex 120 of the filter assembly 102. In some aspects, the fluid can also pass through the perforations 131.

Figure 3:
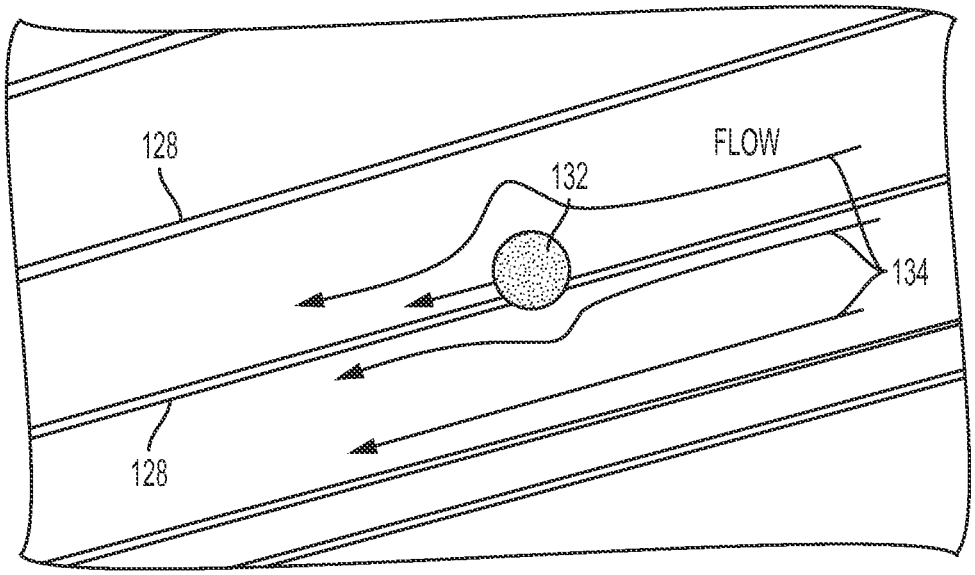
FIG. 3 is a schematic of the flow path of a particle along the filter assembly of FIG. 2, according to an aspect of the present disclosure.

While the fluid can pass through the longitudinal slots 128 the debris particles within the fluid that have a width greater than the width of the longitudinal slots 128 can be stopped at the longitudinal slots 128. Some particles can be stopped at the longitudinal slots 128 proximate to the apex 120 of the filter assembly 102. Some of the particles can be stopped at the longitudinal slots 128 proximate to the base 122 of the filter assembly. The particles stopped proximate to the base 122 can be forced along the length of the longitudinal slots 128 towards to the apex 120 by the fluid that flows towards the apex 120 of the filter assembly 102 (as depicted in FIG. 3). The particles forced along the length of the longitudinal slots 128 can collect proximate to the apex 120. The particles can thereby be moved away from the region of the longitudinal slots 128 proximate to the base 122 and fluid can flow continue through the region of the longitudinal slots 128 proximate to the base 122. The particles are thereby flushed away from the region of longitudinal slots 128 proximate to the base 122. The region of the longitudinal slots 128 proximate to the base can remain fully or partially unclogged so that fluid may pass through the region as the particles are forced away from the base 122 and towards the apex 120 along the length of the longitudinal slots 128.

FIG. 3 depicts a debris particle 132 stopped at the longitudinal slot 128. The particle 132 is forced along the length of the longitudinal slot 128 towards the apex 120 of the filter assembly 102 by the flow of fluid 134. In some aspects, including for example the aspect described in FIG. 4, the apex 120 can be positioned downhole from the base 122. In such an aspect, the particle 132 can be stopped at the longitudinal slot 128 proximate to the apex 120 and can be forced towards the base 122 of the filter assembly 102 by the flow of the fluid.

Figure 4:
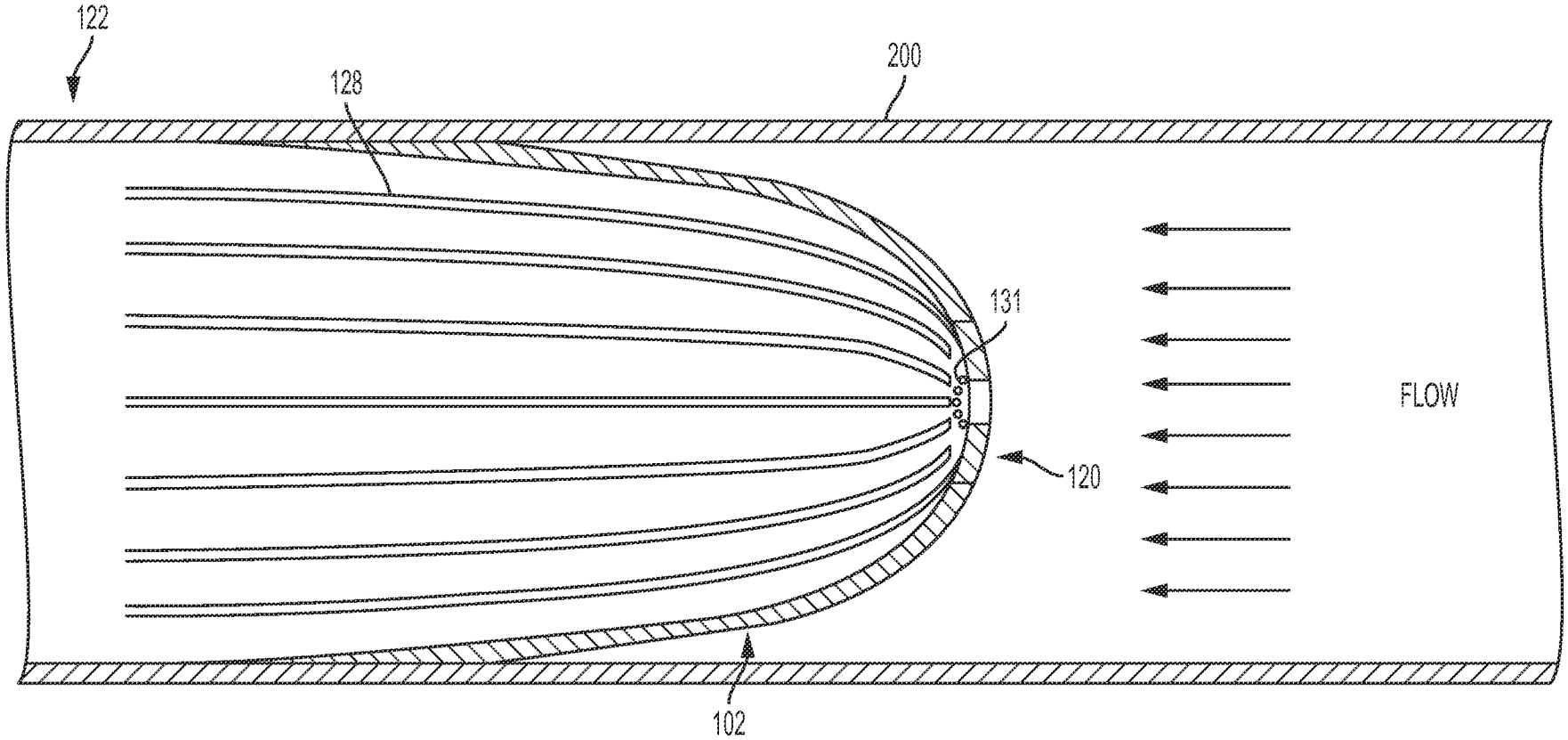
FIG. 4 is a cross-sectional view depicting a filter assembly, according to another aspect of the present disclosure.

FIG. 4 depicts a cross-sectional view of the casing string 200 and filter assembly 102 from FIG. 2 positioned such that the apex 120, instead of the base 122, is positioned downhole. With the apex 120 positioned downhole, the fluid flowing into the casing string 200 first contacts the apex 120 of the filter assembly 102. Similar to the fluid dynamics described with respect to FIG. 2, some of the fluid can pass through the longitudinal slots 128 proximate the apex. Some fluid can also pass through the perforations 131. Particles within the fluid that are larger than the width of the longitudinal slots 128 can be stopped at the longitudinal slots 128. Particles that are stopped proximate to the apex 120 can be forced along a length of the filter assembly 102 towards the base 122. The particles can be forced along the length of the filter assembly 102 by fluid that did not pass through at the apex 120 and instead continued to flow along the longitudinal slots 128 towards the base 122 of the filter assembly 102. The particles can collect proximate to the base 122 of the filter assembly 102. The region of the longitudinal slots 128 proximate to the base 122 of the filter assembly 102 can become partially or fully clogged by the collection of particles.

The region of the longitudinal slots 128 proximate to the apex 120 can remain unclogged as the stopped particles are forced the longitudinal slots 128 away from the apex 120 towards the base 122 of the filter assembly 102. Fluid can continue to flow through the longitudinal slots 128 proximate to the apex 120 even as the particles collect and partially or fully clog the region of the longitudinal slots 128 proximate to the base 122 of the filter assembly 102.

Figure 5:
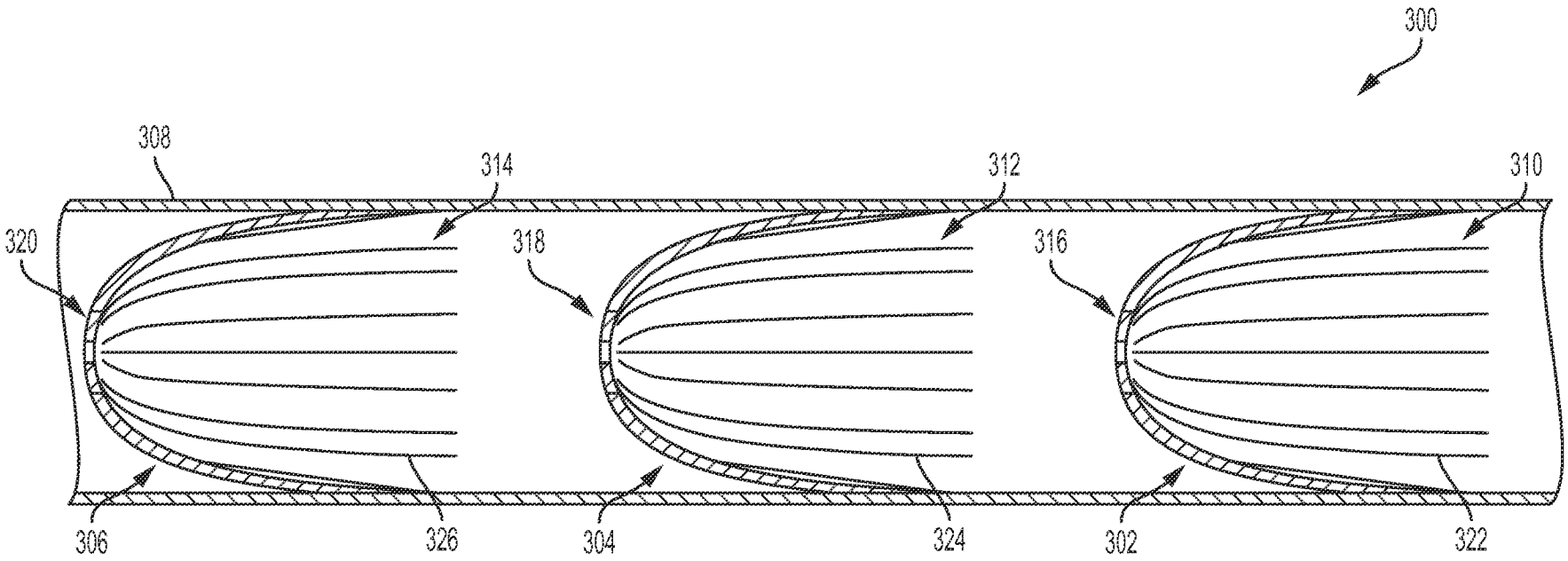
FIG. 5 is a cross-sectional view depicting a filter assembly, according to another aspect of the present disclosure.

FIG. 5 depicts an aspect of the disclosure in which a filter assembly 300 includes a first, second, and third filter element 302, 304, 306 positioned within a casing string 308. The filter elements 302, 304, 306 can each be positioned within the casing string 308 with their respective bases 310, 312, 314 located downhole from their respective apex's 316, 318, 320. The filter elements 302, 304, 306 do not include any perforations at the apex, though in some aspects perforations may be included.

Each of the filter elements 302, 304, 306 can include longitudinal slots 322, 324, 326. The longitudinal slots 322 of the first filter element 302 can be a greater width than the longitudinal slots 324, 326 of the second and third filter elements 304, 306. The longitudinal slots 322 of the first filter element 302 can filter out some of the particles present in the fluid flowing into the casing string 308. The fluid that passes through the first filter element 302 next enters the second filter element 304. The longitudinal slots 324 of the second filter element 304 can have a smaller width than the longitudinal slots 322 of the first filter element 302. The longitudinal slots 324 of the second filter element 304 can stop particles present in the fluid that were small enough to pass through the longitudinal slots 324 of the first filter element 302. The longitudinal slots 326 of the third filter element 306 can have a smaller width than the longitudinal slots 322, 324 and can filter out particles that were small enough to pass through the first and second filter elements 302, 304 but are too large to fit through the longitudinal slots 326.

The longitudinal slots 322, 324, 326 can get progressively narrower with each filter element of the filter assembly 300. The filter elements 302, 304, 306 may be positioned within the casing string 104 to gradually filter out particles present in the fluid that flows through the filter elements 302, 304, 306. The filter elements 302, 304, 306 and the respective longitudinal slots 322, 324, 326 can each function as described in FIG. 2 with respect to the filter assembly 102. The use of multiple filter elements each having successively narrower longitudinal slots can allow the filter elements 302, 304, 306 to function for a longer period of time before ultimately becoming partially or fully clogged by the particles filtered out of the fluid by the filter element 302, 304, 306.

While FIG. 5 depicts the filter assembly 300 including three filter elements, in some aspects more or fewer filter elements can be used. Also, while FIG. 5 depicts each of the filter elements 302, 304, 306 positioned with their respective bases 310, 312, 314 located downhole from their respective apex's 316, 318, 320, some or all of the filter elements 302, 304, 306 could be positioned with their apex located downhole from their base (as described in FIG. 4).

Figure 6:
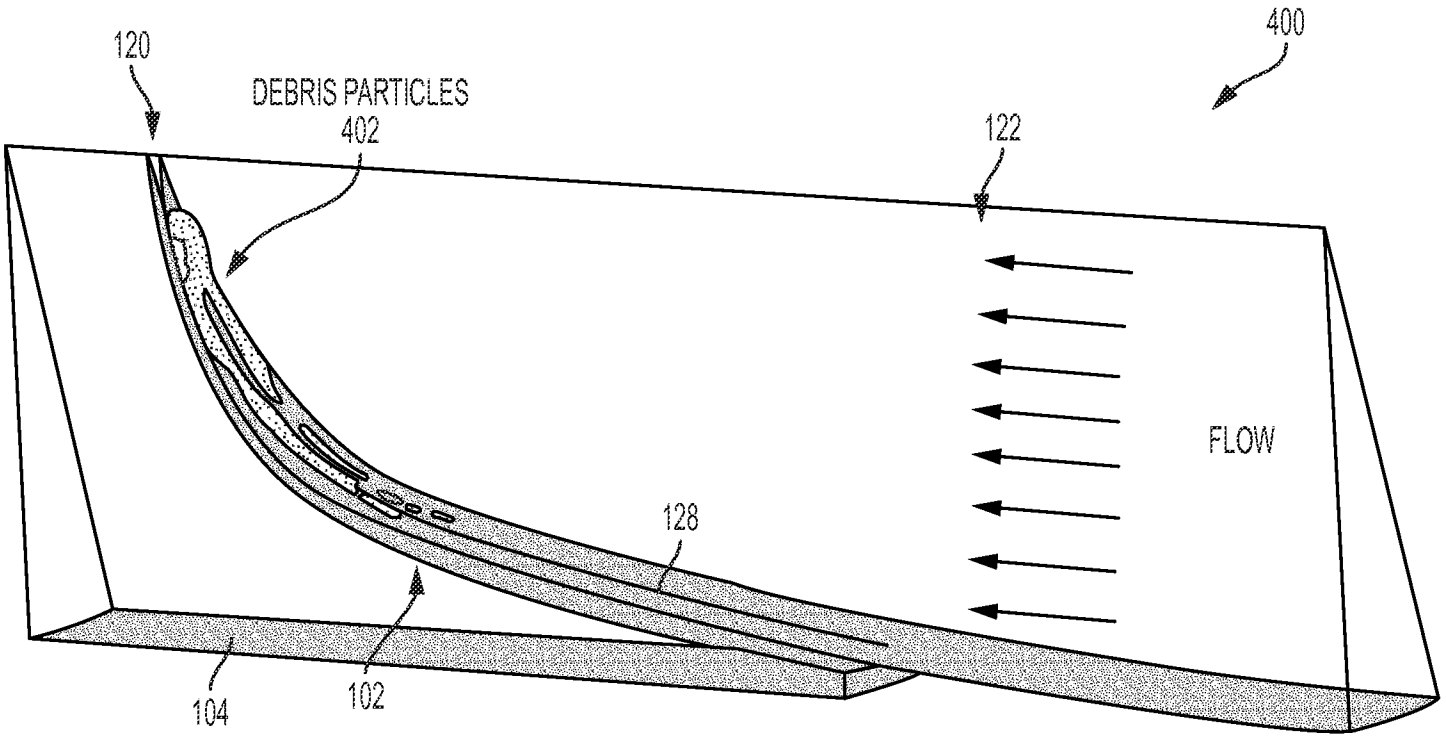
FIG. 6 is a partial cross-sectional view of a debris particle deposit along a length of the filter assembly of FIG. 2, according to an aspect of the present disclosure.

FIG. 6 depicts an exemplary computational fluid dynamics ("CFD") simulation 400 of the deposit of debris particles 402 along a surface of a filter assembly, for example filter assembly 102 (shown in FIG. 2), according to an aspect of the present invention. Fluid can enter the filter assembly 102 at the base 122 and flow towards the apex 120. The simulation 400 demonstrates that a greater amount of debris particles 402 can collect proximate to the apex 120 as compared to the region proximate to the base 122 of the filter assembly 102. The region of the filter assembly 102 proximate to the base 122 has little to no debris particle deposit. The fluid can continue to pass through the region of the longitudinal slots 128 proximate to the base 122 of the filter assembly 102 as the particles collect at the apex 120 and partially or fully clog the region of the longitudinal slot 128 proximate to the apex 120.

Example #1

An apparatus may include a filter element that is positionable in a tubing string. The filter element may include a closed end and an open end. A plurality of slots may extend generally radially from the closed end of the filter element along a length of the filter element to the open end of the filter element.

Example #2

The Example #1 may further include a plurality of perforations positioned at the closed end of the filter element.

Example #3

Any of the Examples #1-#2 may feature the filter element being generally conical in shape.

Example #4

Any of the Examples #1-3 may feature each slot of the plurality of slots having a width that is substantially equal with widths of other slots of the plurality of slots.

Example #5

Example #4 may further feature the width of each slot of the plurality of slots being in the range of approximately 0.1 mm to approximately 0.5 mm.

Example #6

Any of the Examples #1-5 may feature a maximum inner diameter at the open end of the filter element that is substantially equal to an inner diameter of the tubing string.

Example #7

Any of the Examples #1-6 may feature the tubing string being a substitute piece of threaded pipe.

Example #8

Any of the Examples #1-7 may feature the filter element comprising a drillable material.

Example #9

An assembly may include a tubing string that is positionable within a wellbore. A filter element may be coupled to an inner surface of the tubing string. The filter element may have a closed end and an open end. The open end of the filter element may correspond to a maximum inner diameter of the filter element. A plurality of longitudinal slots may be located along a length of the filter element. The plurality of longitudinal slots may extend generally radially from the closed end of the filter element towards the open end of the filter element.

Example #10

The Example #9 may feature the tubing string being a substitute piece of threaded pipe.

Example #11

Any of the Examples #9-10 may further include a plurality of perforations positioned at the closed end of the filter element.

Example #12

Any of the Examples #9-11 may further feature the filter element being generally conical in shape.

Example #13

Any of the Examples #9-12 may feature each slot of the plurality of slots having a width that is substantially equal with widths of other slots of the plurality of slots.

Example #14

The Example #13 may further feature the width of each slot of the plurality of slots being in the range of approximately 0.1 mm to approximately 0.5 mm.

Example #15

Any of the Examples #9-14 may feature the maximum inner diameter at the open end of the filter element being substantially equal to an inner diameter of the tubing string.

Example #16

Any of the Examples #9-15 may feature the length of the filter element being in the range of approximately 1 foot to approximately 6 feet.

Example #17

Any of the Examples #9-16 may include an additional filter element that is coupled to the inner surface of the tubing string. The additional filter element may be generally conical in shape and may include a plurality of longitudinal slots.

Example #18

An assembly may include a filter element that is generally conical in shape. The filter element may have a first end that is positionable downhole for contacting a fluid. The fluid may include particles of debris. The filter element may also include a plurality of slots positioned along a length of the filter element for stopping a particle of debris and directing the particle of debris away from the first end of the filter element towards a second end of the filter element in response to a flow of the fluid.

Example #19

The Example #18 may feature the first end of the filter element being an open end of the filter element. The second end of the filter element may be a closed end of the filter element.

Example #20

The Example #19 may feature the first end of the filter element being a closed end of the filter element. The second end of the filter element may be an open end of the filter element.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A filter apparatus comprising:

a filter element that is positionable in a tubing string, the filter element including a closed end and an open end, the closed end having a curved shape; and a plurality of slots, each slot of the plurality of slots extending generally radially from the closed end of the filter element along a length of the filter element towards the open end of the filter element, wherein each slot of the plurality of slots extends continuously between the closed end and the open end of the filter element.

2. The filter apparatus of claim 1, further comprising a plurality of perforations positioned at the closed end of the filter element.

3. The filter apparatus of claim 2, wherein the filter element is generally conical in shape.

4. The filter apparatus of claim 1, wherein each slot of the plurality of slots has a width that is substantially equal with widths of other slots of the plurality of slots.

5. The filter apparatus of claim 4, wherein the width of each slot of the plurality of slots is in the range of approximately 0.1 mm to approximately 0.5 mm.

6. The filter apparatus of claim 1, wherein the filter element includes a maximum inner diameter at the open end that is substantially equal to an inner diameter of the tubing string.

7. The filter apparatus of claim 1, wherein the tubing string is a substitute piece of threaded pipe.

8. The filter apparatus of claim 1, wherein the filter element comprises a drillable material.

9. A filter assembly comprising:

a tubing string positionable within a wellbore;

a filter element coupled to an inner surface of the tubing string, the filter element being having a closed end and an open end, the open end having a diameter that corresponds to a maximum inner diameter of the filter element; and a plurality of longitudinal slots located along a length of the filter element, the plurality of longitudinal slots extending generally radially from the closed end of the filter element towards the open end of the filter element, wherein the filter element has a generally parabolic shape.

10. The filter assembly of claim 9, wherein the tubing string is a substitute piece of threaded pipe.

11. The filter assembly of claim 9, further comprising a plurality of perforations positioned at the closed end of the filter element.

12. The filter assembly of claim 9, wherein each longitudinal slot of the plurality of longitudinal slots has a width that is substantially equal with widths of other longitudinal slots of the plurality of slots.

13. The filter assembly of claim 12, wherein the width of each longitudinal slot of the plurality of longitudinal slots is in the range of approximately 0.1 mm to approximately 0.5 mm.

14. The filter assembly of claim 9, wherein the maximum inner diameter of the filter element at the open end of the filter element is substantially equal to an inner diameter of the tubing string.

15. The filter assembly of claim 9, wherein the length of the filter element is in the range of approximately 1 foot to approximately 6 feet.

16. The filter assembly of claim 9, further comprising an additional filter element that is coupled to the inner surface of the tubing string, the additional filter element being generally conical in shape and including a plurality of longitudinal slots.

17. A filter assembly comprising:

a filter element that is generally conical in shape comprising:

a first end positionable downhole for contacting a fluid that includes particles of debris; and a plurality of slots extending through the filter element continuously along a length of the filter element for stopping a particle of debris and directing the particle of debris away from the first end of the filter element towards a second end of the filter element in response to a flow of the fluid.

18. The filter assembly of claim 17, wherein the first end of the filter element is an open end of the filter element and the second end of the filter element is a closed end of the filter element.

19. The filter assembly of claim 18, wherein the first end of the filter element is a closed end of the filter element and the second end of the filter element is an open end of the filter element.

* * * * *